United States Patent [19]

Kränzle

[11] Patent Number: 4,651,929

[45] Date of Patent: Mar. 24, 1987

[54] HOLDING AND CONTROL ARRANGEMENT FOR SPRAYING DEVICES ON HIGH-PRESSURE WASHING EQUIPMENT

[76] Inventor: Josef Kränzle, Auer Str. 42a, D-7918 Illertissen, Fed. Rep. of Germany

[21] Appl. No.: 227,922

[22] Filed: Jan. 23, 1981

[30] Foreign Application Priority Data

Jan. 26, 1980 [DE] Fed. Rep. of Germany ..... 3002790

[51] Int. Cl.[4] ..... B08B 3/02

[52] U.S. Cl. ..... 239/288; 222/473; 239/526

[58] Field of Search ..... 239/288, 525, 526, 530; 222/146 HE, 473, 146.2; 403/331

[56] References Cited

U.S. PATENT DOCUMENTS

| | | | |
|---|---|---|---|
| 997,053 | 7/1911 | Fritz | 403/331 X |
| 3,711,028 | 1/1973 | Hengesbach | 239/530 X |
| 3,739,988 | 6/1973 | Kisor | 239/288 X |
| 3,799,447 | 3/1974 | Beal | 239/526 X |

FOREIGN PATENT DOCUMENTS

| | | | |
|---|---|---|---|
| 2238019 | 2/1974 | Fed. Rep. of Germany | 239/526 |
| 2345504 | 3/1975 | Fed. Rep. of Germany | 239/530 |
| 2647815 | 4/1978 | Fed. Rep. of Germany . | |
| 2730936 | 1/1979 | Fed. Rep. of Germany . | |
| 1554840 | 11/1980 | United Kingdom . | |
| 2067923 | 8/1981 | United Kingdom | 239/526 |

*Primary Examiner*—Andres Kashnikow

*Attorney, Agent, or Firm*—Lowe Price Leblanc Becker & Shur

[57] ABSTRACT

A holding and control arrangement for spraying devices used with high-pressure washing equipment includes water feed and discharge ducts communicating through a valve controlled by a hand lever. Inlet and discharge ends of the respective ducts terminate in upper and lower casing portions interconnected by a protective bar. Each casing portion respectively includes feeder and discharge connection fittings formed with the casings to prevent the fittings from turning. The fittings have similar shapes to enable manipulation by a standard tool, such as a monkey wrench. An outer housing handle including guide flanges capable of interfitting with guide channels formed in the casings substantially covers the water duct and valve to prevent undesired operator contact with these hot portions. An additional covering extends around a portion of the water duct to further prevent operator contact with the hot duct.

16 Claims, 2 Drawing Figures

HOLDING AND CONTROL ARRANGEMENT FOR SPRAYING DEVICES ON HIGH-PRESSURE WASHING EQUIPMENT

TECHNICAL FIELD

This invention relates generally to hand held spraying devices, and more particularly to a holding and control arrangement for spraying devices used with high-pressure washing equipment.

BACKGROUND ART

A holding and control arrangement for spraying devices on washing equipment is known from No. DE-AS 2 345 504, wherein a valve is located in a plastic outer housing together with connections for feeder and discharge lines. The plastic outer housing also operates as a handle to manually control closing of a water duct. The outer housing completely encloses the valve and water duct. When this arrangement is used in high-pressure washing equipment, operating at high temperatures, however, overheating of the outer housing will tend to occur.

In addition, pistol type holding and control arrangements are known wherein the outer housing includes two half shells screwed together. Although the outer housing is provided with openings, these openings are not sufficient for preventing overheating of the outer shell when used in connection with high temperature equipment. Furthermore, when the valve malfunctions, the half shells must be opened by loosening all of the screws. As another disadvantage, when the feeder or spraying lines are screwed on or off, these lines tend to turn within their screwed connections to the valve, increasing the likelihood of leaks.

It is, accordingly, an object of the present invention to provide a holding and control arrangement with improved circulation between the water duct and the outer housing of a hand held spraying device.

Another object of the invention is to provide a structure in such a device in which no leaks can occur due to turning of the feeder or drainage lines.

A further object is to provide a spraying device of the above type having an easily accessible valve.

DISCLOSURE OF INVENTION

A holding and control arrangement for a spraying device, in accordance with the invention, comprises an outer housing including a cover part, and a valve as well as a hand lever for controlling the valve positioned in the housing. Connections of a feeder and discharge duct are also located within the housing. The outer housing also functions as a handle enclosing a water or vapor duct. A protective bar integrated with the housing encloses the area of the hand lever. Fittings of the feeder and discharge duct connections are each embedded in a plastic casing to prevent turning. The protective bar connects the casings. The cover part of the outer housing covers the valve and the water or vapor duct in abutment therewith. Since the fittings of the feeder and discharge lines are embedded in the plastic casing to render the fittings stationary, turning of the lines does not occur. In the area of the valve and the water and vapor duct, the outer housing includes a plurality of openings for improved heat dissipation. The outer housing is easily removed to provide access to the valve.

Still other objects and advantages of the present invention will become readily apparent to those skilled in the art from the following detailed description, wherein I have shown and described only the preferred embodiment of the invention, simply by way of illustration of the best mode contemplated by me of carrying out my invention. As will be realized, the invention is capable of other and different embodiments, and that several details are capable of modifications in various obvious respects, all without departing from the invention. Accordingly, the drawing and description are to be regarded as illustrative in nature, and not as restrictive.

BEST MODE FOR CARRYING OUT THE INVENTION

Figure 1:
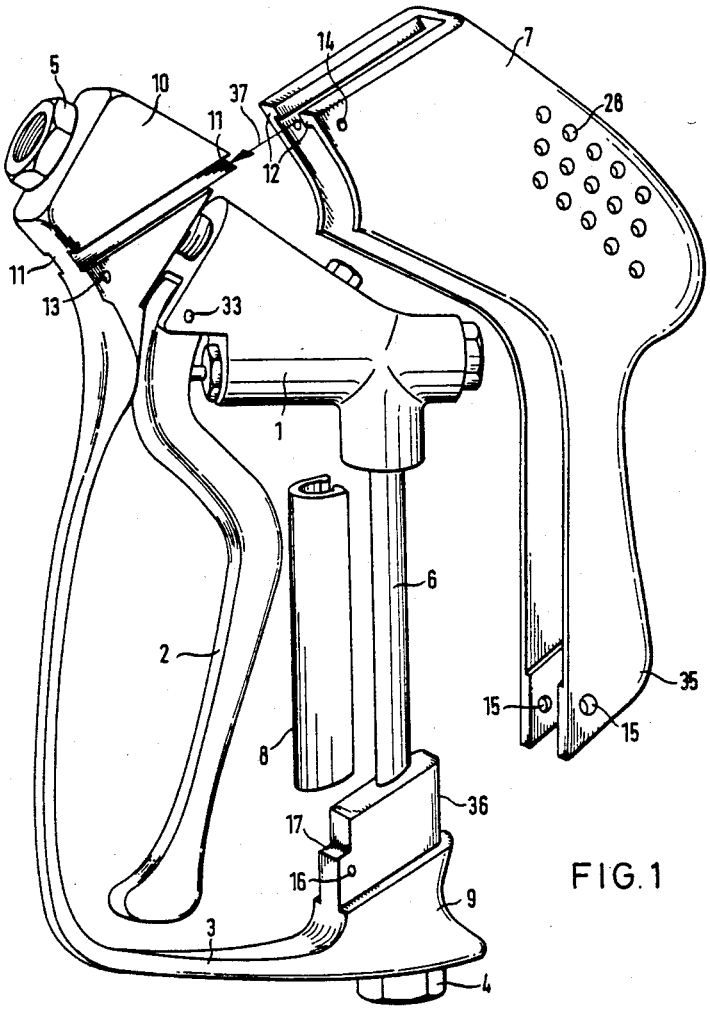
FIG. 1 is an exploded perspective view of a holding and control arrangement, in accordance with the invention.
Figure 2:
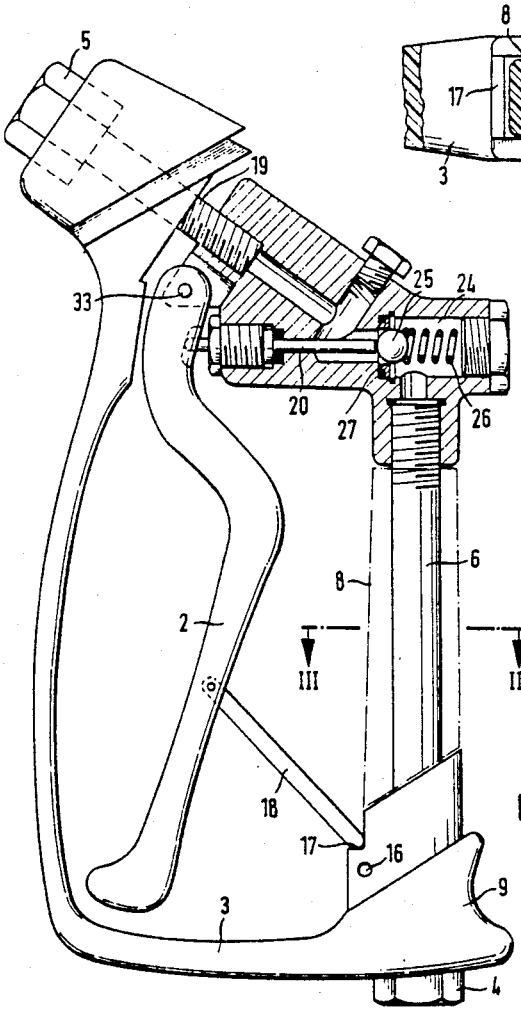
FIG. 2 is a side view of the holding and control arrangement of FIG. 1, illustrating in partial sectional detail, the connection fittings of the feeder and discharge ducts.

Referring to FIGS. 1 and 2, a valve 1 is controlled by a hand lever 2. A water or vapor duct 6 is screwed into the bottom of valve 1, with inlet fitting 4 located at the lower end of the duct. At the outlet side, one end of a discharge line 19 is threadedly received or otherwise mounted into valve 1, and an outlet fitting 5 is attached to the opposite end of the discharge line. In FIG. 2, a valve chamber 24 is located in the valve 1 into which water or vapor is directed. A sealing element, which preferably includes a ball 25, or possibly a disc or cone, is pressed against valve seat 27 by spring 26. One end of rod 20 rests loosely in abutment with sealing element 25. When valve 1 is opened by activating hand lever 2, rod 20 presses sealing element 25 away from valve seat 27. Thus, entrapped lime or dirt particles flow through the valve because the sealing element is moved away from the valve opening outside the flow path. When the valve is closed, by releasing hand lever 2, sealing element 25 returns to a fully closed position.

According to the invention, turning of the inlet and outlet fittings 4, 5 is avoided because the fittings are respectively cast, with lower and upper casings 9, 10, preferably being fabricated of plastic. Preferably, inlet and outlet fittings 4, 5 are similarly shaped to enable a tool, such as a monkey wrench, to be used on them. Guard bar 3, interconnecting casings 9, 10, is preferably molded with the casings to form a stable unitary structure.

Valve 1 and water duct 6 are partially enclosed by outer housing 7. Outer housing 7 includes a plurality of circular openings 28 that permit air circulation for cooling the outer housing. In addition, outer housing 7 is partially open to facilitate slip fittings placement over valve 1 and water duct 6. Upper casing 10 includes corresponding guide channels 11 extending diagonally in relation to discharge line 19. Corresponding guide flanges 12 formed at the upper portion of outer housing 7 slideably interfit with channels 11, enabling the housing to securely cover the duct and valve arrangement. A similar arrangement may be provided at the lower portion of outer housing 7 for secure attachment to lower casing 9. However, as shown in FIG. 1, a reinforced bottom portion 35 of outer housing 7, having thicker side walls than the rest of the outer housing, slideably interfits around a top portion of lower casing 9 dimensioned for placement between the sidewalls of portion 35.

With this design, a secure fit between outer housing 7 and the above corresponding attachment portions of upper and lower casings 9, 10 is assured. Preferably, however, it is desirable to form bore holes 13, 16 respectively in casings 9, 10, capable of alignment with corresponding bore holes 14, 15 formed in outer housing 7, for further securing the parts with pins, screws or other means inserted within the holes.

Figure 3:
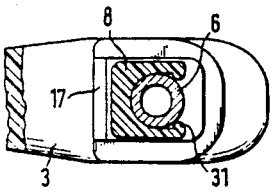
FIG. 3 is an enlarged partial, sectional view taken along the line 3—3 of FIG. 2, illustrating the handle enclosing the water vapor duct.

As discussed above, outer housing 7 prevents the operator's hand from contacting valve 1 or water duct 6 to avoid burning. In addition, covering 8 may be provided for covering the portion of water duct 6 not otherwise enclosed by outer housing 7. As shown in FIG. 1, cover 8 is preferably an elongated U-shaped member including clamping flanges extending along the top edge of the covering and slightly projecting into the channel. With this design, cover 8 may be pressed against water duct 6 and secured to the duct by the flanges. As shown in FIG. 3, cover 8 occupies the interior space intermediate outer housing 7 and water duct 6. However, it will be understood that cover 8 may be formed having thinner channel portions, for the purpose of providing an insulating air gap between the cover and outer housing 7. In addition, water duct 6 may be protected against contact by means of other insulation, such as glued on foam material.

Additional protective covering and activation of valve 1 and water duct 6 are provided by hand lever 2. As shown in FIG. 1, hand lever 2 is pivotally secured to valve 1 at point 33 by a shaft pin or other suitable means. Alternatively, hand lever 2 may be pivotally secured to upper casing 10 (not shown in detail), preferably, at a point as close to the end of valve rod 20 as possible, to ensure maximum pivoting movement when desired. When hand cranking of lever 2 is necessary, the location of the hand lever in front of the exposed parts of valve 1 and water duct 6 is operative to prevent hand contact with these parts. In the assembled structure, further protection from the aforesaid exposed hot parts is achieved by forming the lower portion of hand lever 2 to interfit between the side walls of outer housing 7.

For the purpose of preventing accidental activation of hand lever 2, stop bar 18 may be provided. One end of stop bar 18 is pivotally secured to hand lever 2, with the opposite end of the stop arm capable of being positioned within notch 17 formed in the inside of lower casing 9. Stop bar 18 is a safety device and may be removed from notch 17 when hand lever 2 activation is necessary.

In this disclosure, there is shown and described only the preferred embodiment of the invention, but, as aforementioned, it is to be understood that the invention is capable of use in various other combinations and environments and is capable of changes or modifications within the scope of the inventive concept as expressed herein.

For example, although the preferred embodiment of the invention has been described as a pistol shaped holding and control means, other embodiments are possible for use in holding and control means wherein the axis of the feeder and discharge ducts are approximately parallel to each other as in No. DE-AS 2 345 504.

I claim:

1. A holding and control arrangement for spraying devices used with high-pressure washing equipment, comprising:

(a) a water or vapor feed duct;

(b) a valve means for controlling flow through said feed duct, said valve means controlled by a hand lever;

(c) a discharge duct for communicating flow from the feed duct through said valve means;

(d) outer housing portions including an outer housing handle substantially covering the valve means and feed duct; and (e) feed and discharge duct connection fittings respectively communicating with each of said ducts, said fittings being embedded within said first and second casings to prevent turning of said fittings, said casings being interconnected by a protective bar partially enclosing said hand lever.

2. A holding and control arrangement according to claim 1, further comprising a covering enclosing a portion of said feed duct not covered by said outer housing handle.

3. A holding and control arrangement according to claim 2, wherein said covering includes an elongated, substantially U-shaped member having clamping means for securing said member to the feed duct.

4. A holding and control arrangement according to claim 1, wherein said hand lever is positioned below the valve means, said hand lever being pivotally connected to a supporting structure and positioned to avoid hand contacting of the valve means during deactivation of said hand lever, said outer housing handle securely covering said valve means and feeder duct.

5. A holding and control arrangement according to claim 1, wherein said hand lever is pivotally secured to the valve means for movement in a common plane with the feed duct.

6. A holding and control arrangement according to claim 1, wherein said hand lever is pivotally secured to an upper portion of said casing for movement in a common plane with the feed duct.

7. A holding and control arrangement according to claim 1, wherein said hand lever is shaped and positioned such that when said lever is in a deactivated position, said hand lever is operative to protect an operator from hand contact with exposed portions of the said valve means and the feeder duct not otherwise covered by said outer housing handle.

8. A holding and control arrangement according to claim 1, wherein said casing includes upper and lower discharge and feeder portions respectively, said discharge portion including a guide groove formed diagonally in relation to the discharge duct, and wherein said outer housing handle includes a guide flange enabling said outer housing handle to interfit within said guide groove.

9. A holding and control arrangement according to claim 8, wherein corresponding guide grooves and guide flanges are provided respectively on opposite sides of the discharge casing portion and outer housing handle.

10. A holding and control arrangement according to claim 8 or 9, wherein said lower casing portion includes guide grooves formed transversely to the water feeder duct, and wherein a bottom portion of said outer housing handle includes corresponding guide flanges capable of interfitting with the guide grooves.

11. A holding and control arrangement according to claim 1, further comprising fastening means for securing said casing portions to the outer housing handle.

12. A holding and control arrangement according to claim 11, wherein said fastening means include bore holes formed in said casings and outer housing handle, and capable of alignment for fastening said casing portions and outer housing together with screws.

13. A holding and control arrangement according to claim 8, further comprising a stopping device pivotally secured at one end to the hand lever, and a notch formed in a portion of said inlet casing, an opposite end of said stopping device being positionable within the notch for preventing accidental activation of said hand lever.

14. A holding and control arrangement according to claim 1, wherein said connection fittings are formed with similar shapes enabling manipulation of said fittings with a tool.

15. A holding and control arrangement according to claim 1, wherein said valve means includes a loosely placed sealing element and valve rod for pushing against said sealing element when said rod is acted upon by the hand lever.

16. A holding and control arrangement according to claim 1, wherein said casings and outer housing handle are formed such that said holding and control arrangement is pistol shaped and the water feeder duct is positioned through a vertical portion of said pistol shaped arrangement.

* * * * *